United States Patent [19]

Ericsson

[11] Patent Number: 4,989,343

[45] Date of Patent: Feb. 5, 1991

[54] DRYING SECTION PROVIDED WITH UV-LIGHT GENERATING DEVICES

[75] Inventor: Sylve J. D. Ericsson, Tumba, Sweden

[73] Assignee: Svecia Silkscreen Maskiner AB, Norsborg, Sweden

[21] Appl. No.: 372,752

[22] Filed: Jun. 28, 1989

[30] Foreign Application Priority Data

Jun. 28, 1988 [SE] Sweden ..... 8802431

[51] Int. Cl.[5] ..... F26B 3/28

[52] U.S. Cl. ..... 34/4; 250/504 R

[58] Field of Search ..... 34/17, 4, 41, 155, 23, 34/1; 250/504 R, 492.1

[56] References Cited

U.S. PATENT DOCUMENTS 3,840,448 10/1974 Osborn et al. .
4,089,123 5/1978 Ericsson et al. .
4,143,468 3/1979 Novotny et al. ..... 34/4 X
4,168,579 9/1979 Ericsson .
4,414,755 11/1983 Ericsson .
4,494,316 1/1985 Stephansen et al. ..... 34/4
4,526,101 7/1985 Ericsson .
4,538,358 9/1985 Ericsson .
4,545,131 10/1985 Ericsson .
4,798,960 1/1989 Keller et al. ..... 34/4 X

FOREIGN PATENT DOCUMENTS 451381 10/1987 Sweden .

*Primary Examiner*—Henry A. Bennet
*Attorney, Agent, or Firm*—Burns, Doane, Swecker & Mathis

[57] ABSTRACT

The invention relates to a drying section which includes UV-light generating devices for drying a coloring substance applied to a material, for instance, colored print applied to print material and a silkscreen printer, and further comprising a conveyor for conveying the material passed one or more of the UV-light generating devices. The UV-light generating devices are cooled and a light and gas permeable grid is arranged between the material and each UV-light generating device. The grid has the form of three glass plates which define therebetween a plurality of apertures defined by recesses formed in the edge margins of respective glass plates.

19 Claims, 1 Drawing Sheet

DRYING SECTION PROVIDED WITH UV-LIGHT GENERATING DEVICES

TECHNICAL FIELD

The present invention relates to a drying section, and particularly, but not exclusively, to a drying section of the kind which includes UV-light generating devices.

The drying section is intended for drying wet colouring substances applied to print material, and the inventive drying section has been developed for drying print applied to print material in a silk screen printer.

Printing sections of the kind referred to will normally include a conveyer arrangement by means of which the print material can be conveyed past one or more of the aforesaid UV-light generating devices.

Since each of the UV-light generating devices will also generate thermal energy, it is normally necessary to provide means for cooling the UV-light generating devices.

It is also known to use a light and gas permeable grid structures and to locate one such grid between the print material and said UV-light generating device.

The grid is normally provided with cavities which are disposed over an area which will usally exceed 90% and which is intended to allow ultra-violet light to pass therethrough.

BACKGROUND PRIOR ART

Several different kinds of drying sections of the aforesaid kind, intended for use within the aforesaid technical field are known to the art.

An example of one such drying section is illustrated and described in the U.S. Pat. No. 4,551,925.

Thus, it is previously known to use a drying section comprising UV-light generating devices in a silk screen printer, for the purpose of drying print applied to print material in the printer, the print being applied with the aid of a colouring substance which is particularly adapted for drying with the aid of ultraviolet light.

It is also known that the composition of the colouring substances, and also the ability to harden said substances by ultraviolet light, is contingent on hardening in an inert atmosphere, if it is to be possible to effect the drying or hardening process at low energy consumptions.

An example of drying systems using ultraviolet light in an inert gaseous atmosphere is described and illustrated in U.S. Pat. No. 3,840,448.

It is also known to those skilled in this art that the UV-light generating devices used will generate large quantities of thermal energy and that it is therefore possible to use such a drying section when the colouring substance used to produce the print can be heat-dried.

The colouring substances can then be water-based colours.

Thus, the use of UV-light generating devices in drying sections affords the advantage of enabling one and the same drying section to be used for two or more different colouring substances.

Attempts have also been made to reduce the extent to which an inert gas is required during the drying stage.

The Swedish publication No. SE-B-451 381 teaches a quartz plate which is arranged to enclose a heat module divided into two parts, wherein a central slot and two edge related slots are arranged in parallel with one another and in a plane beneath the heating elements.

The slots are intended to conduct cooling air between the material 11 and the plate 60.

The Swedish publication thus teaches an arrangement in which gas (air) is able to flow past the heat generating devices, such as to cool said devices and then passes through a glass plate onto the material, so as also to cool the material. This arrangement might be considered to have something in common with the present invention.

THE DIFFERENCES BETWEEN THE PRESENT INVENTION AND THE SUBJECT MATTER OF SE-A-451 381.

Significant constructional differences are to be found between the known arrangement and the present invention, which in themselves assume principally different fundamental conditions. Thus, in the case of the known arrangement the cooling air has to pass a dense array of quartz heating lamps, and is therefore heated prior to passing through the slots and down onto the material.

According to the present invention, only a part of the cooling air, normally a minor part of the cooling air, will pass around the lamp and cool the same, whereas the remainder of the cooling air will pass through discrete apertures in the glass plate and onto the material. Thus, the mutual differences between the known arrangement and the inventive arrangement do not only lie in the passage taken by the cooling air between and past respective heating lamps, but also in the use of slots and the use of discrete edge-related apertures.

This last-mentioned difference, i.e. the difference between slots and apertures formed in the edge margins of respective plates, is of decisive significance, inter alia because:

(a) the air flowing through a slot will probably be highly concentrated to elongated regions instead of being distributed between discrete localities, this latter resulting in effective cooling and air distribution;

(b) it is more difficult to adjust or adapt the width of the slots to attain a desired cooling air flow than when adjusting the size and distribution of the apertures provided in accordance with the invention (the number of apertures);

(c) it is more difficult to adjust the width of the slots to attain a desired cooling air flow than by enabling the size and distribution of the apertures to be adjusted by forming the apertures in the form of recesses exclusively in the edge margins of the glass plates;

(d) it is more difficult to adjust the slot width to attain a desired, modified air flow than it is to displace mutually adjacent glass plates relative to one another or to simply change the places of one or more of the glass plates;

(e) it is thought that the cooling air will be heated to higher temperatures when it is forced to pass a dense array of heating lamps than when it is allowed to pass between heating lamps and glass plates and is deflected through discrete apertures formed by recesses provided in the edge margins of respective glass plates, down onto the print material.

SUMMARY OF THE INVENTION

TECHNICAL PROBLEMS

When considering the state of the prior art as described above with respect to drying sections which include UV-light generating devices, and particularly when such drying sections are used to dry print applied to print material in a silk screen printer, it will be seen that a technical problem resides in the provision between the print material and the UV-light generating device of a light and gas permeable grid of such construction that while being gas tight to the greatest possible extent the grid will still permit free passage of ultraviolet light without incurring excessively large losses and which will enable air or inert gas to pass through a few suitably positioned and specifically configured apertures in the grid.

A further technical problem is one of realizing that a grid which exhibits the aforesaid technical features should preferably have the form of two or more, mutually adjacent glass plates comprising a material through which ultraviolet light can pass and in which said apertures can be positioned along the edge margins of respective glass plates.

Another technical problem is one of realizing that when the grid has the form of two or more mutually adjacent glass plates positioned edge-to-edge, a qualified technical problem is one of realizing that said apertures can be provided in simplest manner, simply by forming one or more recesses along at least one edge margin of at least one glass plate.

For the purpose of attaining pre-determined orientation, size and shape of the apertures desired, a further technical problem resides in realizing that in the case of mutually contiguous edge margins of respective glass plates a first recess formed in one glass plate shall be positioned immediately adjacent a second recess formed in the other glass plate, such as to create a multiple of small apertures in mutually adjacent relationship.

It will also be seen that a further technical problem resides in realizing that when the first and the second recesses are so positioned adjacent one another that they both contribute in forming one and the same aperture, it is also possible to form relatively large apertures with the aid of small recesses formed in respective edge margins of the plates.

Another technical problem is one of realizing that when using glass plates the first recess formed in the edge margin of one glass plate shall be spaced from a second recess formed in the edge margin of the other, mutually adjacent or contiguous glass plate, so that each of the recesses contributes in forming a respective aperture and therewith provide conditions for forming small apertures which are located closer together than the aforementioned larger apertures.

It will also be seen that a further technical problem is one of realizing the advantage afforded when the grid is comprised of glass plates which have recesses formed in mutually parallel, longitudinally extending edge margins of the plate, since the positioning of the apertures and the size of said apertures can be determined by mutual displacement of mutually adjacent glass plates.

A further technical problem is one of providing a simple structure which will amplify the transportation of inert gas upstream of the material conveying direction, such as to ensure thereby that the inert gas will encompass the material during the drying process, since it can be assumed that the inert gas will accompany the material in the material conveying direction.

It will also be seen that a further technical problem is one of providing a drying section with which the UV-light generating device, or devices, can be cooled in a simple and effective manner, by enabling the use of an inert gas, for instance nitrogen, with the inert gas in its liquid phase, which therewith requires a relatively large amount of thermal energy to convert the liquid to its gas phase and also energy for heating the gas, this energy being taken from the UV-light generating devices and therewith cooling the same.

Another technical problem resides in a provision of a drying section which is not only dimensioned sufficiently to satisfactorily cool the UV-light generating devices, but which can also be used to cool, at least to some extent, the print material, thereby preventing excessive dimension changes in the material as it passes the drying section.

SOLUTION

For the purpose of solving one or more of the aforesaid technical problems there is provided in accordance with the present invention a drying section which includes UV-light generating devices which are intended to dry colouring substance applied to a material, for instance, to print material in a silk screen printer, a conveyer arrangement adapted for conveying print material past one or more UV-light generating devices, and preferably means for cooling said UV-light generating devices, and further including a light and gas permeable grid arranged between said material and said UV-light generating device.

It is proposed in accordance with the present invention that the grid of the aforesaid drying section has the form of a glass plate, a UV-light permeable glass plate, and that the glass plate is provided with a number of apertures in widely spaced relationship along the glass plate.

In accordance with one proposed embodiment of the invention, the grid has the form of two or more mutually adjacent, elongated glass plates with the apertures positioned in the edge margins of respective plates.

Preferably, the grid will have the form of two or more mutually adjacent glass plates, in edge-to-edge relationship, with the number of plates used ranging from two to five, preferably three to four, and in which said apertures are formed by providing one or more recesses in at least one edge margin along at least one glass plate.

For the purpose of forming large apertures, it is proposed that a first recess in one of the mutually contiguous edge margins of respective plates is positioned immediately adjacent a second recess in an edge margin of the other glass plate, and in that the first and the second recesses are so positioned adjacent one another as to contribute to form one and the same aperture.

When a larger number of apertures of smaller dimensions are required, it is proposed that a first recess provided in an edge margin of the mutually contiguous edge margins of respective glass plates is positioned at a distance from a second recess formed in an edge margin of the second glass plate, such that each will contribute to form a respective one of said apertures against a flat edge margin of an adjacent glass plate.

When the drying section is particularly constructed for drying print at a low energy input and when the print comprises a colour substance which will harden when exposed to ultraviolet light and which thus requires the presence of an inert gas, it is proposed that the number of apertures and the dimensions of said apertures upstream of the material conveying direction are selected such as to afford a greater transportation of gas in this region than that afforded by corresponding dimensions and numbers of apertures and aperture dimensions downstream of the conveying direction, since it can be expected that the inert gas will accompany the material as it is moved beneath the ultraviolet light generating devices.

In order to enable the UV-light generating devices to be cooled effectively, and/or to be able to cool the print on the print material, it is proposed that there is used an inert gas, for instance nitrogen, and then particularly an inert gas in its liquid phase, the conversion of said liquid phase to the gas phase being effected by the heat generated by the UV-light generating device and therewith taking thermal energy generated by said device.

ADVANTAGES

Those advantages primarily characteristic of an inventive drying section reside in the provision of means whereby UV-light generating devices can be readily enclosed in a casing and in which a large surface area of the grid comprises a gas-impermeable surface and which is provided with specially configured and specially oriented small and minor recesses or apertures through which gas can pass.

In addition, means are provided for cooling the UV-light generating devices effectively, by utilizing the thermal energy generated by said devices to convert an inert gas in its liquid phase to its gas phase.

Furthermore, in addition to those colouring substances which are adapted for hardening by UV-light generating devices, the drying section also enables colouring substances to be dried which are adapted for heat drying.

BRIEF DESCRIPTION OF THE DRAWINGS

A preferred drying section having characteristic features significant of the present invention will now be described in more detail with reference to the accompanying drawings, in which.

DESCRIPTION OF A PREFERRED EMBODIMENT

Figure 1:
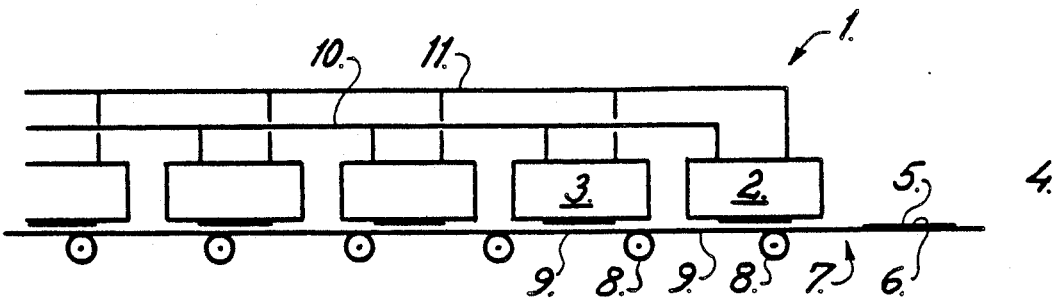
FIG. 1 is a simplified, side view of a drying section having a plurality of UV-light generating devices arranged in series.

FIG. 1 is a side view, greatly simplified, of a drying section 1 comprising a plurality of UV-light generating devices arranged in series, said devices being of mutually identical construction and the first two of said devices being referenced 2 and 3 respectively.

The UV-light generating devices are intended, sequentially, to dry a colouring substance applied to print material. This is illustrated in FIG. 1 with a silk screen printer indicated at 4 in which print 5 is applied to print material 6, which is conveyed through the drying section 1 by a conveyer arrangement 7 in the form of an endless belt 9 resting on rollers 8. The belt 9 is driven continuously or discontinuously, for transportation of the print material 6 past one or more of the UV-light generating devices represented by device 2, 3.

Normally, a drying section of the kind illustrated in FIG. 1 will require means for cooling each of the UV-light generating devices, and accordingly the illustrated embodiment is equipped with a system of pipes 10 through which cooling air is delivered to each of said UV-light generating devices.

Although not shown, the pipe system 10 will incorporate valves and control devices.

However, such a drying section, which includes UV-light generating devices, will normally be intended to harden or dry wet colouring substances under an inert atmosphere. To this end, each of the UV-light generating devices is connected to a further pipe system 11 through which an inert gas is delivered to respective devices. Although not shown, this further pipe system 11 will also incorporate valves and control devices.

It should be mentioned, however, that normally only the pipe system 10 or only the pipe system 11 will be activated, and consequently it will be assumed in the following that the pipe system 11 is activated, such as to create an inert atmosphere when hardening the print 5 on the print material 6.

Figure 2:
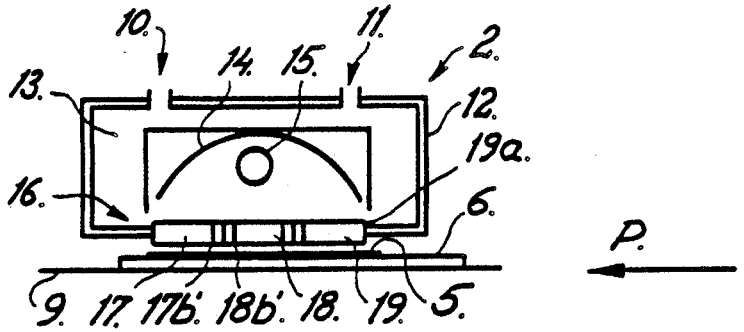
FIG. 2 is a sectional view of one of the UV-light generating devices shown in FIG. 1.

Since all of the UV-light generating devices of the FIG. 1 embodiment are identical in construction, the following description of these devices, made with reference to FIG. 2, will deal solely with the device 2 illustrated schematically and in cross-section in said figure.

Thus, it will be seen from FIG. 2 that the UV-light generating device 2 comprises an outer casing 12 to which pipes belonging to the pipe systems 10 and 11 are connected, and a frame structure 13 or inner casing which secures a reflector 14 in place adjacent an UV-light generating lamp 15.

The configuration of the reflector 14, and the lamp attachment means are known in themselves and will not therefore be described with reference to FIG. 2.

An important feature of the present invention, however, is that a light and gas permeable grid 16 is positioned adjacent to and in front of the lamp 15, the grid being located between the print material 6 and the lamp 15 and attached to the outer casing 12.

In accordance with the present invention, the grid 16 has the form of an UV-light permeable glass plate structure which has provided therein a plurality of sparsely distributed small and minor apertures which enable a distributed gas flow to pass therethrough and which are arranged in a pre-determined pattern.

The glass plate structure 16 shall cover at least 80% of the total surface area, preferably 90%. The apertures are arranged so as to cover a very small part of the total surface area, for instance normally from 2–5%, depending on the size of the drying section and the estimated capacity.

One significant advantage of the invention is that it enables the apertures to be distributed and dimensioned in the manner desired in a very simple fashion. This distribution and dimensioning of the apertures in accordance with prevailing requirements can be effected by interchanging the glass plates and/or by displacing one glass plate in relation to an adjacent glass plate.

In order to enable such adjustments to be made in a simple and ready fashion, it is proposed in accordance with the invention that the grid structure comprises three, mutually adjacent glass plates, references 17, 18 and 19. The apertures are located in the edge margins of respective glass plates and have the form of recesses formed in said edge margins, as will be described in more detail herebelow with reference to FIG. 3.

Figure 3:
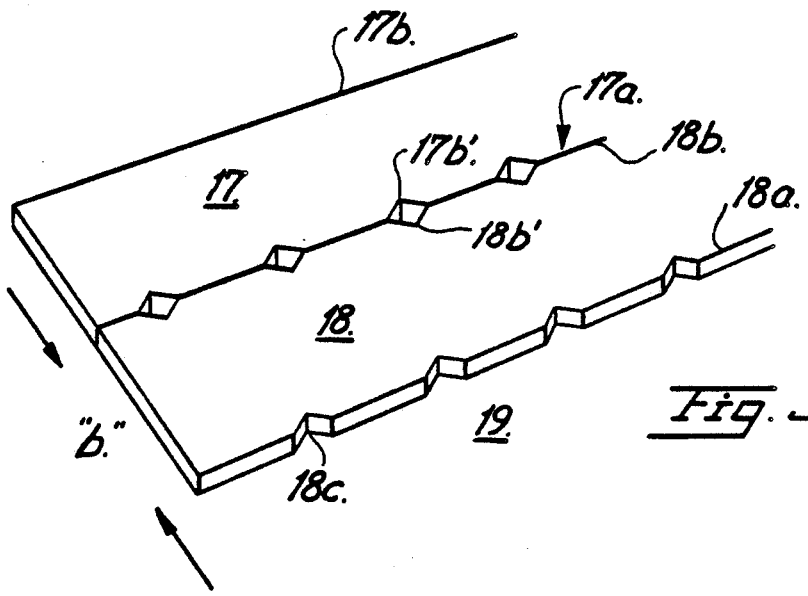
FIG. 3 is a perspective view of an inventive grid structure comprising a plurality of glass plates arranged in edge-to-edge relationship.

It is proposed in accordance with the invention that the grid structure has the form of two or more mutually adjacent glass plates, placed in edge-to-edge relationship, of which only the glass plates 17 and 18 are shown, in perspective, in FIG. 3, and that the apertures are formed by providing along at least one edge margin 17*a* of at least one glass plate 17 one or more mutually spaced recesses, of which one is referenced 17*b*'.

The number of elongated glass plates used may be varied from between two and five, although in practice it has been found that from three to four plates should be used.

Although not shown in FIG. 3, a first recess 17*b*' formed in the edge margin 17*a* of one glass plate 17 of the mutually adjacent glass plates will be positioned immediately adjacent to but laterally displaced in relation to the second recess 18*b*' formed in the edge margin 18*b* of the other glass plate 18. This enables two smaller apertures to be formed adjacent one another, by positioning one recess against a straight edge part of the adjacent glass plate.

In the FIG. 3 embodiment, however, the glass plates 17 and 18 are positioned in relation to one another such that the first and second recesses 17*b*', 18*b*' are in register with one another to form a single aperture, i.e. a large aperture, (17*b*', 18*b*').

By displacing the illustrated glass plates relative to one another, it is possible to locate the aforesaid first recess in one glass plate at a distance from the second recess in the other glass plate, such that each of said recesses will form a separate aperture or opening. Thus, it can be envisaged that the recess 18*c* will face toward a straight edge part of an adjacent glass plate and will be located midway between two recesses on the glass plate 19, not shown in FIG. 3.

Although the edge margin 17*b* of the glass plate 17 of the illustrated embodiment has no recesses formed therein, it will be understood that similar recesses may also be formed in this edge margin of the plate.

It will be obvious from FIG. 3 that the number of apertures and the dimensions of said apertures can be pre-selected, the distance between the apertures when seen in the conveying direction being determined by the breadth "b" of respective glass plates and where the number of apertures transversely to the conveying direction and the size of said apertures is dependent on the extent to which recesses have been provided in the edge margins of respective glass plates.

However, it is proposed that the number of apertures and the dimensions of said apertures upstream of the material conveying direction (for instance at an edge part 19*a* of the glass plate 19) are selected such as to allow greater transportation of gas than the number of apertures and, for instance, the dimensions of said apertures downstream of the conveying direction (for instance at the edge parts 18*b*, 17*a*), which in principle means that the apertures 18*c* shall be larger and denser than the apertures formed by the recesses 17*b* and 18*b*' when the conveying direction is assumed to be that illustrated by the arrow "P" in FIG. 2.

It is also proposed in accordance with the invention that the means used to cool the UV-light generating devices or lamps 15, is an inert gas, for instance nitrogen, and that the gas is converted to its liquid state and delivered through the pipe system 11.

The liquid coolant is thus delivered to the interior of the casing 12, where the liquid is heated and converted to its inert, gaseous state, the thermal energy required herefor being taken from the heat generated by the lamps 15. The generated gas is allowed to pass through a lower gap in the frame 13, and passes around and adjacent to the lamp 15 and the reflector 14, whereafter the gas passes through the apertures 17*b*, 18*b*' and 18*c*, so as to enable the inert gas to develop in the space between the grid 16 and the material 6 carrying print 5.

Although the attachment devices required to hold the glass plates 17, 18 and 19 in place are not shown, it will be obvious that these devices may have a simple construction which will enable the glass plates to be readily exchanged or interchanged when wishing to change the flow pattern of the inert gas.

It will be understood that the invention is not restricted to the aforedescribed, exemplifying embodiments of the invention, and that modifications can be made within the scope of the invention defined in the following claims.

I claim:

1. A drying section which includes UV-light generating devices for drying a coloring substance applied to print material in a silk screen printer, a conveyer arrangement for conveying the material past at least one of the UV-light generating devices, means for cooling the UV-light generating devices, and a light and gas permeable grid located between the material and the UV-light generating device, wherein the grid is a glass plate structure of two or more mutually adjacent and contiguous glass plates; and a plurality of apertures are provided in the glass plate structure along edge margins of respective plates.

2. A drying section according to claim 1, characterized in that the grid has the form of two or more mutually contiguous glass plates arranged in edge-to-edge relationship; and in that said apertures are formed by means of one or more recesses provided in at least one edge margin of at least one glass plate.

3. A drying section according to claim 2, characterized in that the grid comprises from two to five, preferably three to four glass plates.

4. A drying section according to claim 2, characterized in that a first recess located in the edge margin of one of the mutually adjacent glass plates is located immediately adjacent a second recess formed in an edge margin of the other glass plate.

5. A drying section according to claim 4, characterized in that the first and the second recesses are located adjacent one another such as to form one and the same aperture.

6. A drying section according to claim 2, characterized in that in the case of mutually contiguous edge margins, a first recess in the edge margin of a first glass plate is located at a distance from a second recess in the edge margin of a second glass plate, and in that each of said recesses form a separate aperture.

7. A drying section according to claim 1, characterized in that the number of apertures provided and the dimensions of such apertures upstream of the material conveying direction is selected for greater transportation of gas than the number of apertures and the dimensions of said apertures provided downstream of the material conveying direction.

8. A drying section according to claim 1, characterized in that the means for cooling said UV-light generating devices comprises an inert gas, for instance nitrogen.

9. A drying section according to claim 8, characterized in that the inert gas is delivered in its liquid phase.

10. A drying section comprising UV-light generating devices for drying a coloring substance applied to print material in a silk screen printer, conveying means for conveying the material past at least one of the UV-light generating devices, means for cooling the UV-light generating devices, and a light and gas permeable grid located between the material and a respective one of the UV-light generating devices, said grid comprising a plurality of glass plates, wherein at least two glass plates are placed in edge-to-edge relationship; the plates present a plurality of apertures provided in the edge margins of respective plates; and said apertures are defined by one or more recesses formed along at least one edge margin of at least one glass plate.

11. A drying section according to claim 2, characterized in that the grid has the form of two or more mutually contiguous glass plates arranged in edge-to-edge relationship; and in that said apertures are formed by means of one of more recesses provided in at least one edge margin of at least one glass plate.

12. A drying section according to claim 11, characterized in that the grid comprises from two to five, preferably three to four glass plates.

13. A drying section according to claim 3, characterized in that a first recess located in the edge margin of one of the mutually adjacent glass plates is located immediately adjacent a second recess formed in an edge margin of the other glass plate.

14. A drying section according to claim 11, characterized in that a first recess located in the edge margin of one of the mutually adjacent glass plates is located immediately adjacent a second recess fromed in an edge margin of the other glass plate.

15. A drying section according to claim 12, characterized in that a first recess located in the edge margin of one of the mutually adjacent glass plates is located immediately adjacent a second recess formed in an edge margin of the other glass plate.

16. A drying section according to claim 15, characterized in that the first and the second recesses are located adjacent one another such as to form one and the same aperture.

17. A drying section according to claim 14, characterized in that the first and the second recesses are located adjacent one another such as to form one and the same aperture.

18. A drying section according to claim 15, characterized in that the first and the second recesses are located adjacent one another such as to form one and the same aperture.

19. A drying section according to claim 3, characterized in that in the case of mutually contiguous edge margins, a first recess in the edge margin of a first glass plate is located at a distance from a second recess in the edge margin of a second glass plate, and in that each of said recesses form a separate aperture.

* * * * *